US006260484B1

(12) United States Patent
Billings

(10) Patent No.: US 6,260,484 B1
(45) **Date of Patent: *Jul. 17, 2001**

(54) SHOTGUN CARTRIDGE AND SHOTSHELL WAD

(76) Inventor: Chris L. Billings, 105 Whitesides St., Layton, UT (US) 84044

( * ) Notice: Subject to any disclaimer, the term of this patent is extended or adjusted under 35 U.S.C. 154(b) by 0 days.

This patent is subject to a terminal disclaimer.

(21) Appl. No.: 09/453,052

(22) Filed: Dec. 2, 1999

Related U.S. Application Data

(63) Continuation-in-part of application No. 09/313,312, filed on May 17, 1999.

(51) Int. Cl.[7] ..... F42B 7/08
(52) U.S. Cl. ..... 102/453; 102/532
(58) Field of Search ..... 102/448–463, 102/532

(56) References Cited

U.S. PATENT DOCUMENTS

| | | | | |
|---|---|---|---|---|
| 1,864,916 | | 6/1932 | Gachassin . | |
| 3,279,375 | * | 10/1966 | Herter | 102/451 |
| 3,299,813 | * | 1/1967 | Rickey | 102/451 |
| 3,516,360 | | 6/1970 | Lathrope . | |
| 3,974,775 | | 8/1976 | Kerzman et al. . | |
| 4,295,426 | * | 10/1981 | Genco et al. | 102/451 |
| 5,874,689 | * | 2/1999 | Alkhatib et al. | 102/453 |

FOREIGN PATENT DOCUMENTS

| | | | | |
|---|---|---|---|---|
| 201048 | * | 6/1983 | (DE) | 102/449 |
| 92430 | * | 11/1968 | (FR) | 102/532 |
| 2559892 | * | 8/1985 | (FR) | 102/451 |

* cited by examiner

*Primary Examiner*—Harold J. Tudor
(74) *Attorney, Agent, or Firm*—Dowell & Dowell, P.C.

(57) ABSTRACT

A sporting gun cartridge and wad therefor wherein such wad, generally taking the form of a shotshell wad for shotguns, for example, includes a first, forwardly oriented cylindrical portion and also a second, rearwardly oriented cylindrical portion, joining the first portion at a common partition juncture, wherein the side wall of the first portion is scored to provided a series of expandable and separable wall segments, spaced from the forward end of such first portion, whereby to afford relief from impaction of shot disposed within said first portion under firing conditions.

8 Claims, 2 Drawing Sheets

SHOTGUN CARTRIDGE AND SHOTSHELL WAD

CROSS REFERENCE TO RELATED APPLICATIONS

This application is a continuation-in-part of U.S. patent application Ser. No. 09/313,312 filed May 17, 1999, entitled Sporting Gun Cartridge and Wad Therefor in the name of the same inventor.

BACKGROUND OF THE INVENTION

1. Field of the Invention

This invention pertains to sporting gun cartridges, such as cartridges that are useful with shotguns for example. In particular, the invention pertains to cartridges that have a special wad, commonly known for example as shotshell wad, of believed superior design.

2. Brief Description of Prior Art

Tangentially related to the present invention are two known U.S. Pat. Nos. as follows: 1,864,916, issued Jun. 28, 1932 and 3,516,360, issued Jun. 23, 1970. U.S. Pat. No. 3,974,775, issued Aug. 17, 1976, teaches the concept of separable forward fins, but this defeats the close shot pattern made possible by the closed, unsegmented, essentially cylindrical wad forward extremity in the present invention.

Cartridges for sporting guns such as shotguns is a well developed art. Earlier cartridges did not employ shotshell wads since lead shot was used. Lead, being a soft metal, would not score the interior of the barrel of the shotgun. However, the art progressed where steel pellets were employed in lieu of lead shot, and steel, being a harder material than lead, would score and damage the interior of the bore. Because of this, shotshell wads made of plastic were developed for the purpose of carrying the shot forwardly along the interior of the barrel without the shot coming in direct contact with the bore surface. Upon firing, then, the wad would proceed forwardly containing the shot and, once the muzzle area was reached, the plastic wad would advance forwardly with the shot but, hopefully, would gradually drop down out of the line of fire. A problem has occurred in connection with the wad tumbling, which would have an effect of distorting the flight pattern of the shot from that intended. More seriously, upon firearm firing, shot or pellets in the forward portion of the wad will tend to hang up or experience impaction within the wad in the presence of air pressure pressing rearwardly against the shot, and the increased shot-wad frictional effects resulting therefrom and from shot inertia under initial conditions retard shot separation from the wad at and beyond the muzzle location. The present invention overcomes this difficulty by scoring the forward portion of the shotshell wad wall, rearwardly of the latter's forward end, in a manner to delineate the series of wall segments proximate the area containing the shot or pellets. This will be described more fully hereinafter. At this point, and what the prior art does not teach, is the concept of providing a wad having delineated forward wall segments, stopping short of the wad forward closed end—thereby maintaining the integrity of such end—to produce a restricted shot pattern; in one form of the present invention, the rear tubular portion of the wad can include rearwardly oriented fins, see the applicant's co-pending U.S. patent application Ser. No. 09/313,312, filed May 5, 1999, fully incorporated herein by way of reference herein, so that once the muzzle area is reached, such fins will fan outwardly and peripherally about the wad so as to direct its flight and likewise, secondarily, supply an aerodynamic frictional drag whereby to permit the wad to drop behind and then fall out of the advancing shot. This latter feature, relating to the rearwardly directed fins, may not be strictly necessary, depending upon wad dimensions, the nature of the charge of shot, pellets, etc.

BRIEF DESCRIPTION OF THE INVENTION

In the present invention an elongated, essentially cylindrical, plastic shotshell is provided. The same has a forwardly directed shot receiving portion, an intermediate interior partition, and a rearwardly directed charge receiving portion. The rearward receiving charge portion may be provided with a series of mutually spaced longitudinal wall scores. These define between such scores wall segments that are constructed for a radial outward expansion or movement in a circumferential pattern, once the shotshell wad leaves the muzzle of a firearm, under firing compression conditions. The radial circumferential pattern of the wall segments or fins serve primarily to maintain the firing direction, i.e., the central longitudinal axis of the firearm bore, such that the shotshell wad does not tend tumble in flight. Rather, the wad proceeds forwardly in a straight manner; however, as a secondary benefit, the radially expanded fins or wall segments of the wad will tend to provide an aerodynamic frictional drag to the shotshell wall, allowing the same to simply drop out of the flight pattern.

More importantly, the essential thrust of the present invention is to provide a shotshell wad wherein the forward portion thereof, designed to contain the shot, is scored by a series of crease scores or cut scores, whereby to provide thereat a series of radially expandable wall segments stopping short of the shotshell wad forward end. The shotshell wad forward end is itself closed, unscored, and thereby maintains its integrity as a closed ring, and operates to provide a close shot pattern in flight relative to the latter approaching the target. The purpose of the expandable wall segments is to relieve impaction or bang-up of the shot within the wad, upon gun firing, at the muzzle point, owing to the initial condition inertia of the shot and, more especially, the reverse-direction air pressure present, tending to press the shot against the base or partition of the wad. Expansion of the wall segments, radially outwardly, provides sidewall air passage relief areas, communicating with the inter-shot cavities or interstices, so as to free the shot to advance forwardly rapidly from the wad, thereby permitting the wad to fall freely out of the line of fire while the shot-charge advances forwardly to its target.

The invention constitutes therefor both the unique design of the shotshell wad herein and also the sporting gun cartridge, e.g. a shotgun cartridge, that incorporates the wad.

OBJECTS

Accordingly, a principle object of the present invention is to provide a new and improved wad for sporting firearms.

An additional object is to provide an improved shotshell wad for firearms such as shotguns.

An additional object is to provide a ballistic cartridge incorporating a wad of a type to improve firing accuracy and easy separation of the wad from the shot proceeding from the firearm after the muzzle area is passed.

IN THE DRAWINGS

The features of the present invention may best be understood by reference to the following description taken in connection with the accompanying drawings in which.

Figure 1:
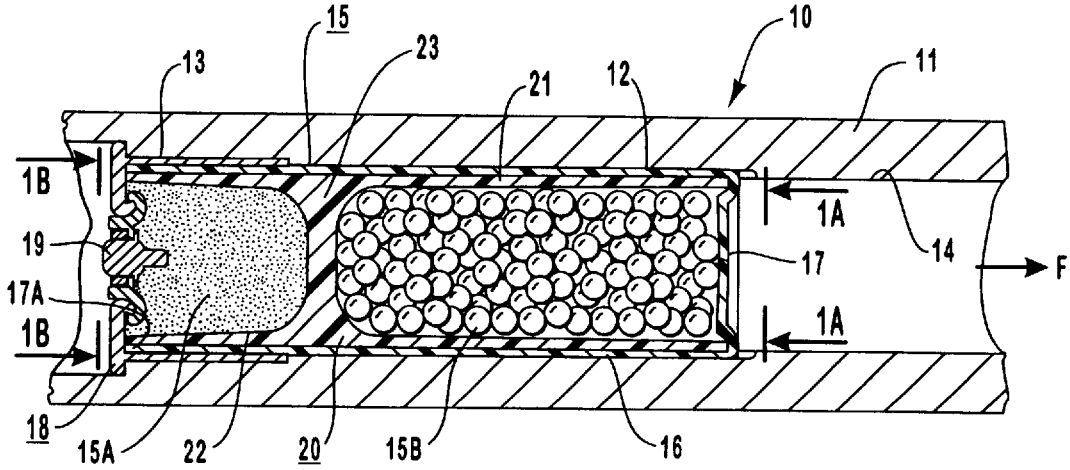
FIG. 1 is a fragmentary, longitudinal, sectional view of a firearm barrel that has received for firing the cartridge of the present invention.
Figure 2A:
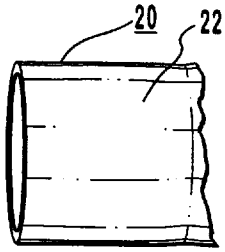
FIG. 2A is a fragmentary detail of the left or rearward end of the wad of FIG. 2, illustrating that such end can be plain, or unscored, for certain applications.
Figure 2:
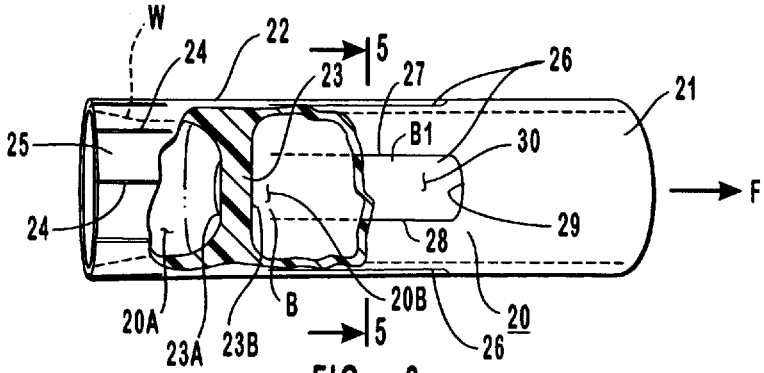
FIG. 2 is a side elevation, partially broken away and shown in section, of the shotshell wad used in the structure of FIG. 1.
Figure 3:
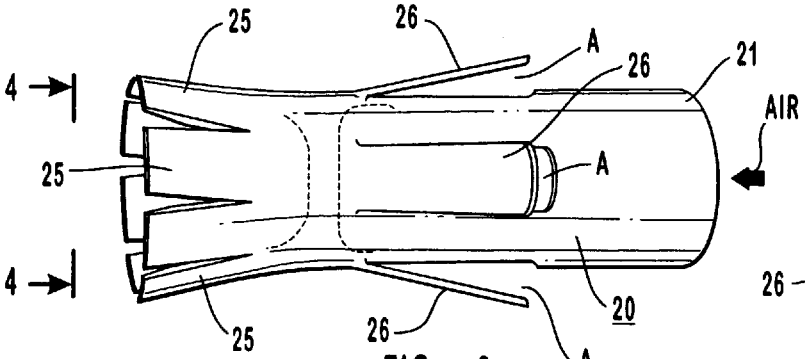

FIG. 3 is a side-elevation perspective of the wad of FIG. 2 wherein, once the wad has proceeded passed the muzzle end of the firearm barrel, the front, side wall segments expand outwardly, the rear portion thereof, this time also being scored, also expanding radially outwardly—the scores under firing compression being ruptured so as to delineate the outwardly expanding fins—so that the shot shell wad will proceed in flight in the direction F as shown in FIGS. 1 and 3 prior to the same dropping out of the line of flight.

Figure 4:
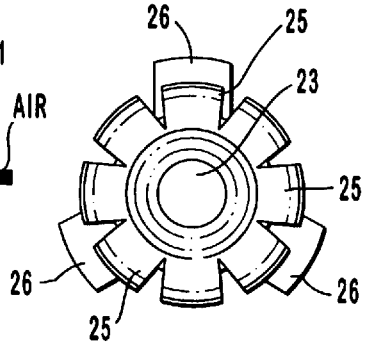

FIG. 4 is an end view taken along the line 4—4 in FIG. 3.

Figure 5A:
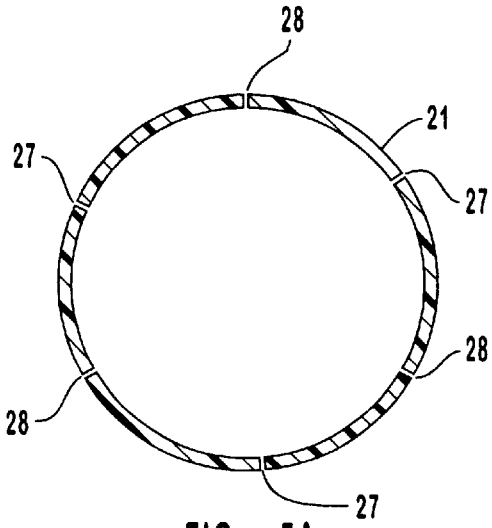
Figure 5B:
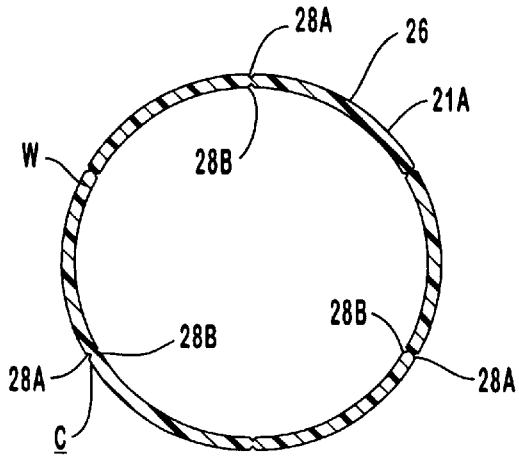

FIGS. 5A, 5B are respective sections taken along the line 5—5 in FIG. 2, illustrating that the scores employed to delineate the side wall segments of the forward portion of the wad, may comprise cut scores, FIG. 5A, or crease scores, FIG. 5B, wherein the wall at the prospective rupture areas are of reduced wall thickness, as by the inclusion of side-opposite, aligned grooves.

Figure 6:
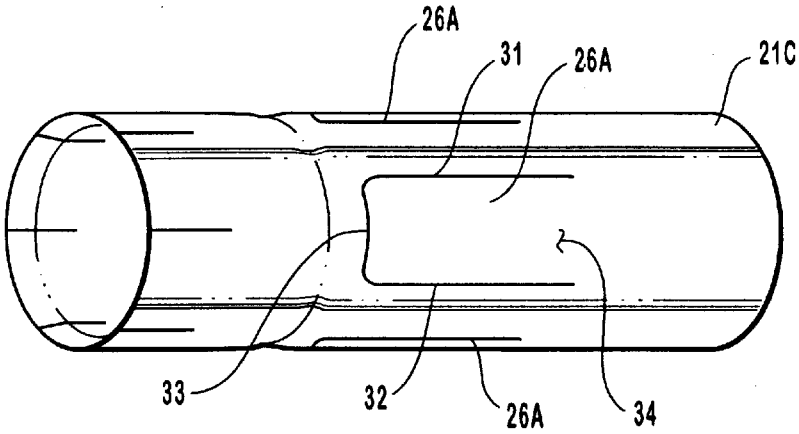

FIG. 6 is a perspective view, is similar to FIG. 2, but illustrates the wad as having wall segments oriented in a reverse direction.

Figure 7:
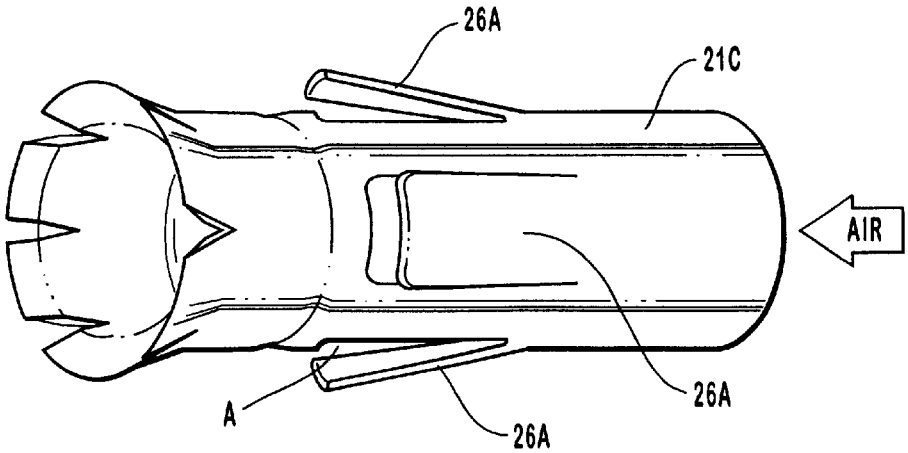

FIG. 7 illustrates the wad of FIG. 6 in the condition of wall segment and fin expansion, after the wad leaves the firearm, illustration relative to the segments, air-escape apertures are now provided to loosen in impaction of shot within the wad.

BRIEF DESCRIPTION OF PREFERRED EMBODIMENTS

Figure 1A:
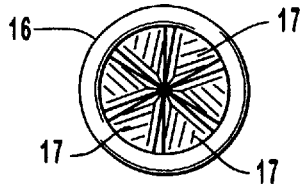
FIG. 1A is a front elevation taken along the line 1A—1A in FIG. 1.
Figure 1B:
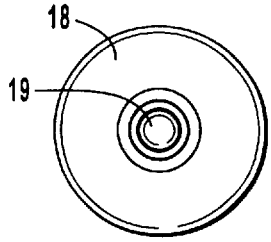
FIG. 1B is a rear elevation taken along the line 1B—1B in FIG. 1.

In FIG. 1 firearm 10 includes barrel 11 having cartridge receiving bore 12. Rearward of bore 12 is an annular rim seat 13. Barrel 11 of course includes the main bore 14. Cartridge 15 includes a cartridge case or hull 16 made of plastic, cardboard, and the like. The hull 16 includes end segments 17 which are simply crimped inwardly to close the forward end of cartridge 15. See FIG. 1A. At its rear end 17A the cartridge hull 16 is provided with an annular rim cap 18, the latter being provided with primer 19.

Interior of hull 16 is a plastic shotshell wad 20, the same including a forward tubular cylindrical portion 21 and also a rearward cylindrical tubular portion 22. The same are provided with a common juncture taking the form of partition 23, the latter having side-opposite faces defining respective bases 23A, 23B of cavities 20A, 20B. Positioned within the hollow interior of the rearwardly extending portion 22 will be a charge of powder 15A contiguous with primer 19. Disposed within the forwardly oriented tubular cylindrical portion 21 will be a charge of a shot 15B such as steel pellets by way of example.

FIG. 2 is of course a perspective, side elevation view of the plastic shotshell wad incorporated in the cartridge structure of FIG. 1. It will be noted in connection with FIGS. 1 and 2 that the forward tubular cylindrical portion 21 of the wad is provided with scores, i. e. crease scores, see FIG. 5B, or cut scores or slits, see FIG. 5A, which delineate side wall segments 26. Scores 27 and 28 of the individual segments 26 are side opposite and may be parallel, if desired; score 29 delineates the forward end 30 of representative segment 26. Segment base B is, of course, integral with the wad wall and hence is not scored. The rearwardly projecting rearward, essentially cylindrical tubular portion 22 can include a series of elongated scores defining wall segments or fins 25.

The rearwardly disposed fins, as well as the forward wall segments, designed into the wad may be as few as three, as seen in FIG. 3, or many more in number such as indicated in FIG. 4 as fins 25.

Relative to the cylindrical wall W of the wad at forward cylindrical portion 21, the wall segments have borders B1 immediately inside the scores; these borders will be severed, if crease scores are employed, from the remainder of the wad once the latter proceeds under firing condition to the muzzle of the gun barrel. FIG. 5A illustrates cut scores or slits at 27 and 28 delineating the wall segments of wad forward portion 21. FIG. 5B shows an alternative forward portion 21A in which the scores C are employed in lieu of slits, the crease scores C being formed by side-opposite respective grooves 28A, 28B, whereby to provide wall weakened areas at the margins or borders of the segments 26. The wad will of course be made of a light-weight plastic such as polyurethane or polyethylene, by way of example.

FIG. 6 illustrate a wad having an alternative forward portion 21C, the same this time including rearwardly oriented wall segments 26A defined by scores 31, 32 and 33, whether these be cut scores or crease scores, as before. The respective bases 34 of these wall segments 26A will be unscored, i.e. not subject to severance from the wad during firing conditions.

In summary as to the rearward portion 22 of the wad: Whatever their form, the purpose for the scores is to provide longitudinally disposed weakened or gapped wall areas which will rupture upon firing, that is, where the compression reduced from the explosion within the barrel urges the wall sectors apart and outwardly immediately upon the wad proceeding out the muzzle end of the barrel. Accordingly, a tear or severing occurs at each of the score areas such that the longitudinal wall segments defined by the scores proceed radially outwardly in a peripheral arrangement, to achieve the configuration as shown at the left end of FIG. 3. Herein again, this configuration is rendered possible once the shotshell wad has advanced just beyond the muzzle end of the barrel. Such wall sectors or fins as at 25 in FIG. 3 will serve the principle purpose of guiding the shot in the intended line of fire. This precludes the phenomenon known as tumbling of the wad once it leaves the barrel. Furthermore, the fins serve to produce an aerodynamic drag relative to the wad so that the same simply drops out of formation once the shot by their inertia proceed in a close direction pattern forwardly. The effect is somewhat that of a badminton shuttlecock where, in the case that the player hits the shuttlecock in a given direction, the badminton shuttlecock will be oriented in flight in that direction with the fins or feathers serving to stabilize the travel of the shuttlecock in the intended direction.

In operation, as to the forward portion 21 of the wad, upon firing the wad will advance rapidly toward the muzzle end of the firearm. The shot will accompany the wad forwardly as the muzzle area is reached. However, owing to friction, shot inertia, and most importantly, the air pressure, see air pressure arrows in FIGS. 3 and 7, the shot will tend to be impacted at the forward seat formed by partition 23, tending for the shot and wad to continue together past the muzzle end. This tendency, however, is overcome by the, relatively speaking, incoming air stream to rush through the gaps or interstices between the shot or pellets, and to exhaust out of the provided side apertures A, provided by the progressive radial expansion of the wall segments. This, in essence, fluidizes the shot area proximate the base of the wad partition, and forwardly, so as to allow the slot freely to be thrust forwardly, free of the wad, immediately after the muzzle area is past. Hence, no slug or tumbling effect will be experienced. FIG. 7 illustrates, of course, the alternative wad wherein the segments 26A are oriented rearwardly.

While particular embodiments have been shown and described, it will be obvious to those skilled in the art that various modifications and changes may be made without departing from the essential aspects of the invention and, therefore, the aim in the appended claims is to cover all such modifications and changes as fall within the true spirit and scope of the invention.

I claim:

1. A shotshell wad including a generally cylindrical, plastic body having a first, forwardly directed shot receiving portion having an outer wall and a forward end, an intermediate interior partition, and a second, rearwardly directed charge receiving portion having an outer wall and a rearmost end, said outer wall of said first shot receiving portion being provided with a plurality of wall weakening segments having rearward extremities extending from proximate said intermediate partition toward said forward end, said outer wall of said first shot receiving portion being imperforate from said plurality of wall weakening segments to said forward end, said wall weakening segments being formed so as to open to relieve pressure in an area proximate said intermediate partition within said first shot receiving portion under firing compression condition and upon forward projection of the shotshell wad out of a muzzle of a firearm barrel so as to relieve compaction of shot disposed within said first shot receiving portion and thereby permit said shot to project forwardly, in a controlled pattern, from said first shot receiving portion upon the shotshell wad exiting the muzzle of the firearm barrel, and said outer wall of said second charge receiving portion including a plurality of spaced elongated lines of weakening which extend from said rearmost end toward said intermediate partition, said elongated lines of weakening dividing said outer wall of said second charge receiving portion into a plurality of segments, said elongated lines of weakening being formed such that said segments of said outer wall of said second charge receiving portion separate under firing compression condition and upon forward projection of the shotshell wad from the muzzle of the firearm barrel so that said plurality of segments flare radially outwardly relative to one another to thereby function as fins for stabilizing the shotshell wad to prevent tumbling of the shotshell wad after exiting the muzzle of the firearm barrel.

2. The shotshell wad of claim 1, wherein each of said wall weakening segments is generally u-shaped thereby defining a plurality of wall sections which flare outwardly relative to said outer wall of said first shot receiving portion upon the shotshell wad exiting the muzzle of the firearm barrel.

3. The shotshell wad of claim 2 wherein each of said u-shaped wall weakening segments are formed, such that said wall sections open outwardly toward said forward end of said first charge receiving portion of said body of the shotshell wad.

4. The shotshell wad of claim 2 wherein said u-shaped segments are formed, such that said wall sections open outwardly toward said intermediate partition.

5. A shotgun cartridge including, a cylindrical hull case having forward and rear ends and an annular base rim provided at said rear end of said hull case, said base rim being provided with a primer, a plastic shotshell wad including a generally cylindrical, plastic body having a first, forwardly directed shot receiving portion having an outer wall and a forward end, an intermediate interior partition, and a second, rearwardly directed charge receiving portion having an outer wall and a rearmost end, said outer wall of said first shot receiving portion being provided with a plurality of wall weakening segments having rearward extremities extending from proximate said intermediate partition toward said forward end, said outer wall of said first shot receiving portion being imperforate from said plurality of wall weakening segments to said forward end, said wall weakening segments being formed so as to open to relieve pressure in an area proximate said intermediate partition within said first shot receiving portion under firing compression condition and upon forward projection of the shotshell wad out of a muzzle of a firearm barrel so as to relieve compaction of shot disposed within said first shot receiving portion and thereby permit said shot to project forwardly, in a controlled pattern, from said first shot receiving portion upon the shotshell wad exiting the muzzle of the firearm barrel, and said outer wall of said second, charge receiving portion including a plurality of spaced elongated lines of weakening which extend from said rearmost end toward said intermediate partition, said elongated lines of weakening dividing said outer wall of said second charge receiving portion into a plurality of segments, said elongated lines of weakening being formed such that said segments of said outer wall of said second charge receiving portion under firing compression condition and upon forward projection of the shotshell wad from the muzzle of the firearm barrel so that said plurality of segments flare radially outwardly relative to one another to thereby function as fins for stabilizing the shotshell wad to prevent tumbling of the shotshell wad after exiting the muzzle of the firearm barrel.

6. The shotgun cartridge of claim 5, wherein each of said wall weakening segments is generally u-shaped thereby defining a plurality of wall sections which flare outwardly relative to said outer wall of said first shot receiving portion upon the shotshell wad exiting the muzzle of the firearm barrel.

7. The shotgun cartridge of claim 6 wherein each of said u-shaped wall weakening segments are formed, such that said wall sections open outwardly toward said forward end of said first charge receiving portion of said body of the shotshell wad.

8. The shotgun cartridge of claim 6 wherein said u-shaped segments are formed, such that said wall sections open outwardly toward said intermediate partition.

* * * * *